US006995628B2

(12) United States Patent
Asao et al.

(10) Patent No.: US 6,995,628 B2
(45) Date of Patent: Feb. 7, 2006

(54) WAVEGUIDE TWIST HAVING QUADRATE SECTIONS

(75) Inventors: Hideki Asao, Tokyo (JP); Hirotaka Kamino, Tokyo (JP); Naofumi Yoneda, Tokyo (JP); Muneaki Mukuda, Tokyo (JP); Koji Yamasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/698,520

(22) Filed: Nov. 3, 2003

(65) Prior Publication Data

US 2004/0246062 A1 Dec. 9, 2004

(30) Foreign Application Priority Data

Jun. 3, 2003 (JP) ..... 2003-157833

(51) Int. Cl.
*H01P 1/165* (2006.01)

(52) U.S. Cl. ..... 333/21 A; 343/756

(58) Field of Classification Search ..... 333/21 A; 343/756

See application file for complete search history.

(56) References Cited

U.S. PATENT DOCUMENTS 2,729,794 A * 1/1956 Cohn ..... 333/21 A
5,111,164 A * 5/1992 De Ronde ..... 333/21 A

FOREIGN PATENT DOCUMENTS

| | | |
|---|---|---|
| JP | 58-170201 | 10/1983 |
| JP | 6-25302 | 2/1994 |
| JP | 6-223201 | 8/1994 |

* cited by examiner

*Primary Examiner*—Benny Lee
(74) *Attorney, Agent, or Firm*—Oblon, Spivak, McClelland, Maier & Neustadt, P.C.

(57) ABSTRACT

A waveguide unit including a vertically polarized waveguide, a horizontally polarized waveguide, and a waveguide type-polarized wave converter interposed between said waveguides. The waveguide type-polarized wave converter has a slit, the shape of which being combination of two quadrate parts and a connecting part for connecting the two quadrate parts. Those polarized waveguides and polarized wave converter are integrally manufactured but can be divided into two parts.

8 Claims, 7 Drawing Sheets

WAVEGUIDE TWIST HAVING QUADRATE SECTIONS

BACKGROUND OF THE INVENTION

1. Field of the Invention

The present invention relates to a waveguide unit for transmitting and processing microwave or millimeter wave signals. In particular, the present invention relates to the waveguide unit including a waveguide type-polarized wave converter which is interposed between a vertically polarized waveguide and a horizontally polarized waveguide for converting their polarization-planes.

2. Description of Related Art

For a transmission path of a micro wave or millimeter wave band, for example, a rectangular waveguide having sides with one-to-two relation has generally been used.

In order to convert vertically polarized wave signals to horizontally polarized wave signals, further, a twisted waveguide 1 as shown in FIG. 11 has been conventionally utilized, the twisted waveguide 1 being made of e.g. aluminum, copper, or copper pyrites. In the drawing, when vertically polarized wave signals enter into a left end opening, their polarization-planes are gradually changed or turned along the axis of the unit and horizontally polarized wave signals are finally output from its right end opening. The above conventional waveguide assures small reflecting performance over the broad band, but, due to the structure in which the waveguide is gradually twisted, it requires for considerable length in the direction to which electromagnetic waves travel, resulting in size or weight increase. The conventional waveguide also requires a high-definition curved surface, therefore, an advanced manufacturing technique is required, causing high manufacturing cost and unsuitability for high volume production.

The unexamined Japanese patent publication No.83/170201 discloses an another example of a conventional waveguide type-polarized wave converter. FIG. 12 shows a perspective view of the converter described in the Japanese patent publication and illustrates a state in which connecting flanges are disassembled for better understanding.

As shown in FIG. 12, a waveguide type-polarized wave converter 4 made of a thin metal plate is connected between a vertically polarized waveguide 2 and a horizontally polarized waveguide 3 via their respective flanges 2*a*, 3*a*. The waveguide type-polarized wave converter 4 is provided with a resonant window 5 with slits 6*a*, 6*b* at the center. The vertically polarized wave microwave signals that arrived to the resonant window 5 through the vertically polarized waveguide 2 are converted to a horizontally polarized wave component due to asymmetry in the shape of the slits 6 relative to the direction of an electric field. The converted signals are output from the horizontally polarized waveguide 3. The shape of the slit 6 is optimized so that polarized wave signals can produce resonance at the specific frequency and the vertically polarized wave component can be totally converted to the horizontally polarized wave component. This structure ensures size and weight reduction in the unit, but makes narrow the frequency bandwidth which will be able to obtain a proper reflecting characteristic because of the use of localized resonance phenomenon at the slit 5.

Therefore, it is not applicable to communication systems using the broad frequency bandwidth. Furthermore, because the resonance window is formed with the slit provided in the thin metal plate, it is difficult for the converter to be unified with other waveguide parts, resulting in unsuitability for mass production.

SUMMARY OF THE INVENTION

In view of the foregoing, an object of the present invention is to overcome problems mentioned in the conventional structures.

Another object of the present invention is to provide a waveguide unit which ensures downsizing and weight reduction.

A further object of the present invention is to provide a waveguide unit having the broad frequency bandwidth.

A still further object of the present invention is to provide a waveguide unit which can be integrally molded with other waveguide parts.

According to one aspect of the present invention, there is provided, to achieve the above objects, a waveguide unit including a vertically polarized waveguide, a horizontally polarized waveguide, and a waveguide type-polarized wave converter interposed between the polarized waveguides. The waveguide type-polarized wave converter has a slit on a face vertical to its guiding direction, the shape of the slit being constituted by combination of two quadrate parts and a connecting part for connecting the two quadrate parts. Each of the quadrate parts is located on a plane which contains the orthogonal coordinate axes X and Y, and is symmetrically located about the Y axis, each center point of the quadrates being located on the X axis.

According to another aspect of the present invention, there is provided a waveguide unit including a vertically polarized waveguide, a horizontally polarized waveguide, and a waveguide type-polarized wave converter interposed between the polarized waveguides. The polarized waveguides and polarized wave converter are integrally manufactured but can be divided into two parts.

BRIEF DESDCRIPTION OF THE DRAWINGS

The above objects and advantages of the present invention will become apparent from the following detailed description of the preferred embodiments when read in connection with the accompanying drawings, which are given by way of illustration only, wherein like reference numerals designate like or corresponding parts throughout the several views.

Figure 4:
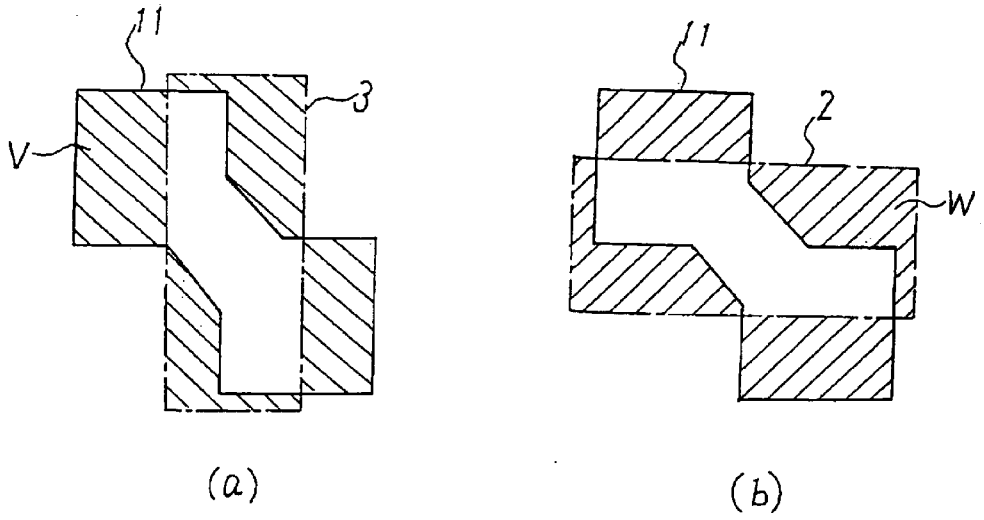

FIGS. 4(*a*) and 4(*b*) are views showing an overlapping state between the slit in the waveguide unit and a vertically polarized waveguide or a horizontally polarized waveguide.

Figure 5:
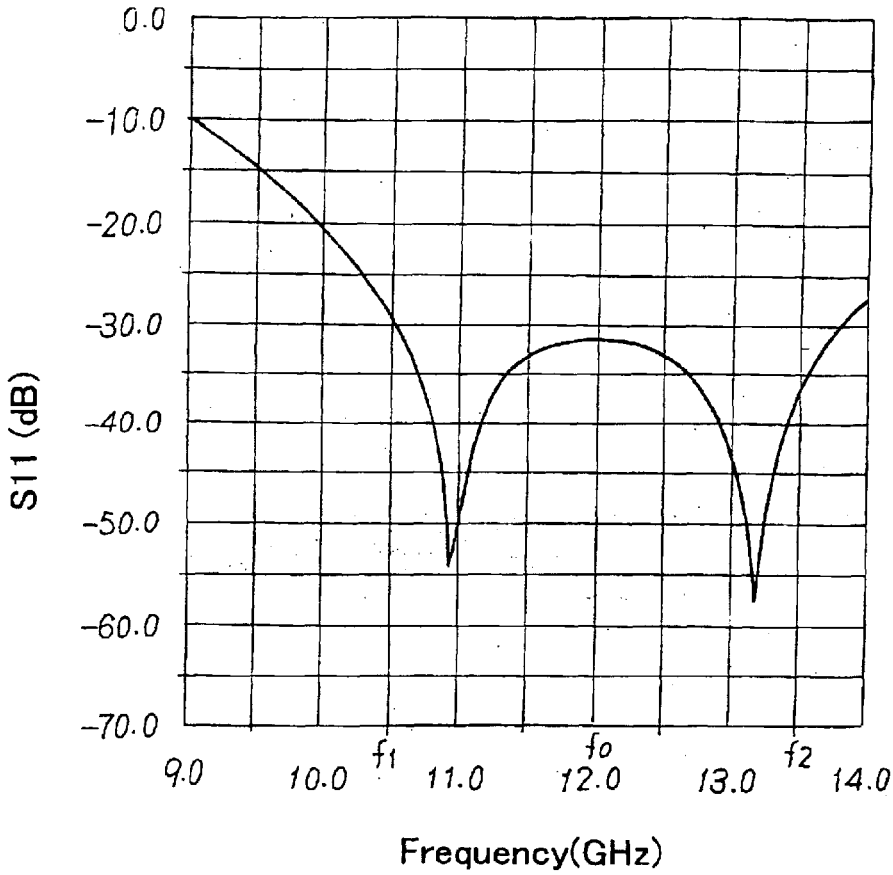

FIG. 5 is a graph showing a reflecting characteristic of the waveguide unit according to the present invention.

Figure 6:
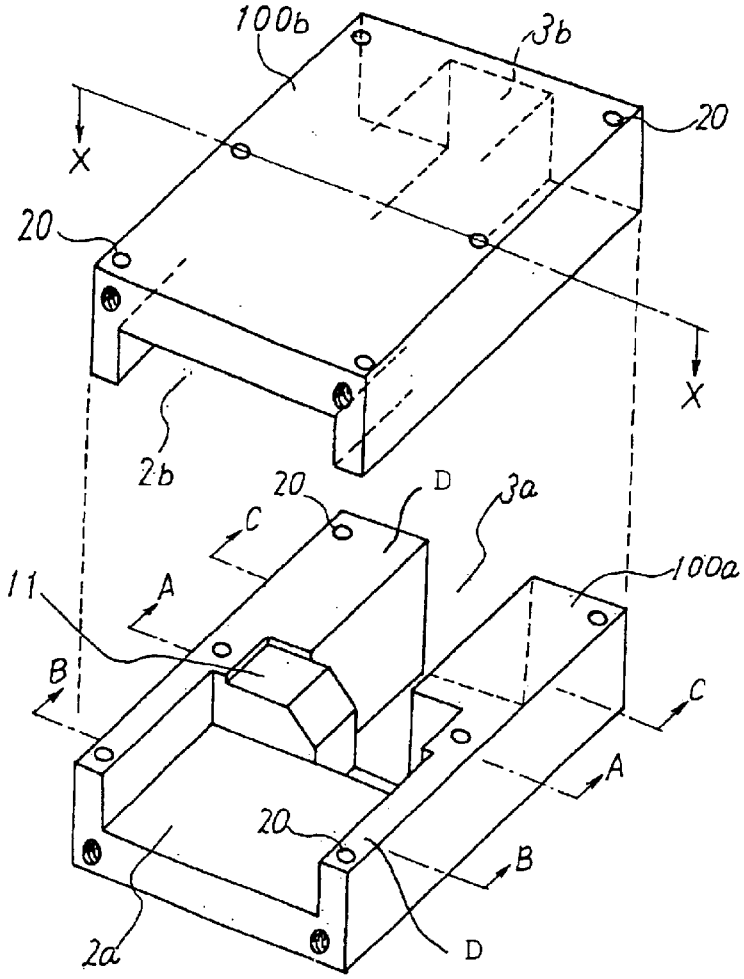

FIG. 6 is an exploded perspective view showing a waveguide unit of an unified or integral type according to a second preferred embodiment of the invention.

Figure 7:
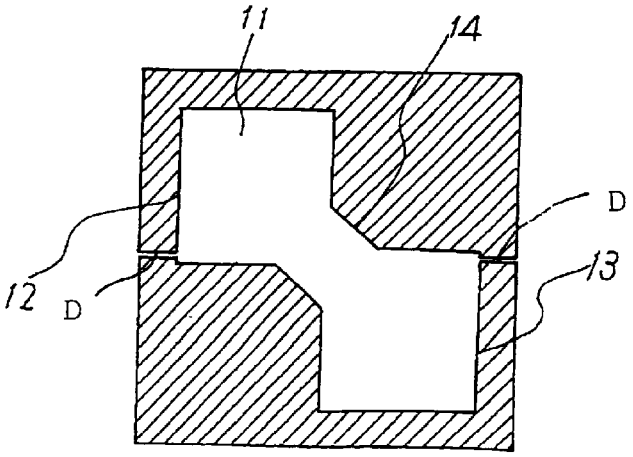

FIG. 7 is a cross sectional view taken in line X—X in FIG. 6 in an assembled state of the waveguide unit.

Figure 8:
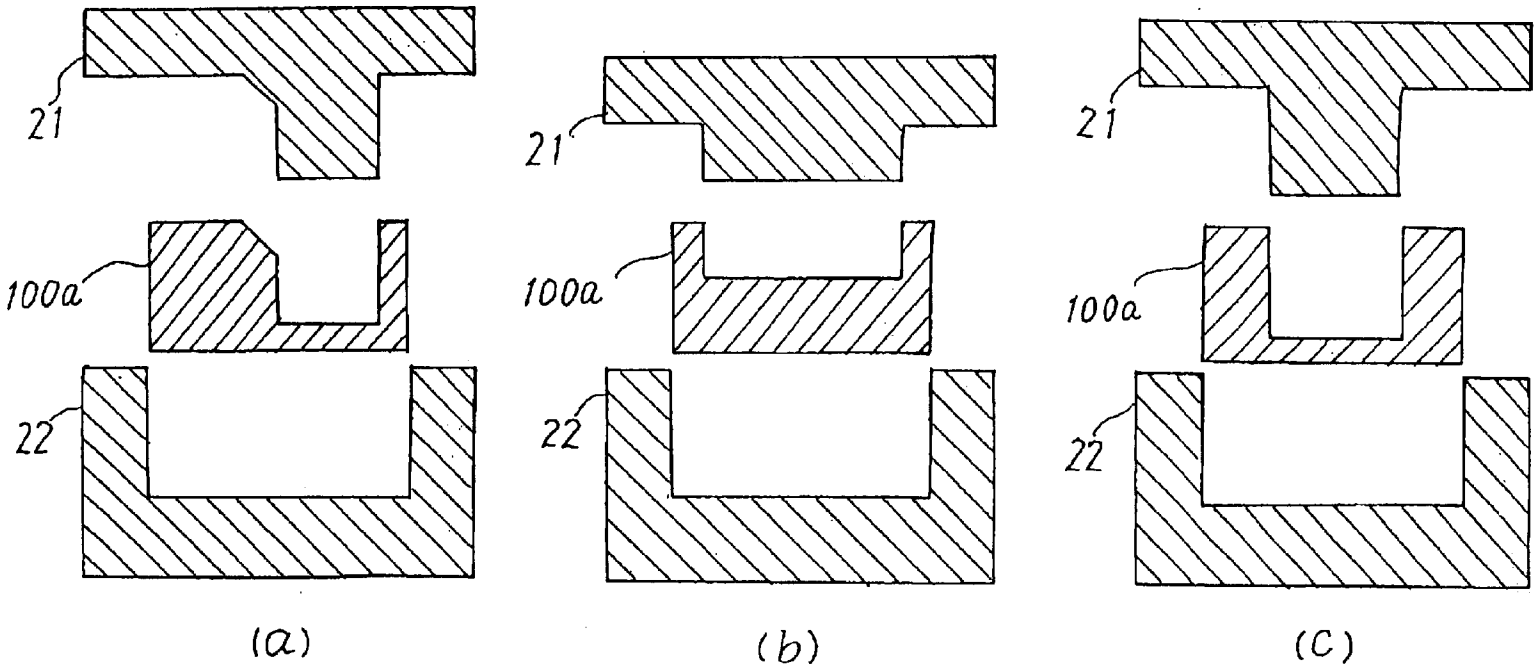

FIG. 8(*a*) to FIG. 8(*c*) are cross sectional views showing metal molds for manufacturing the waveguide unit according to the second preferred embodiment of the invention.

Figure 9:
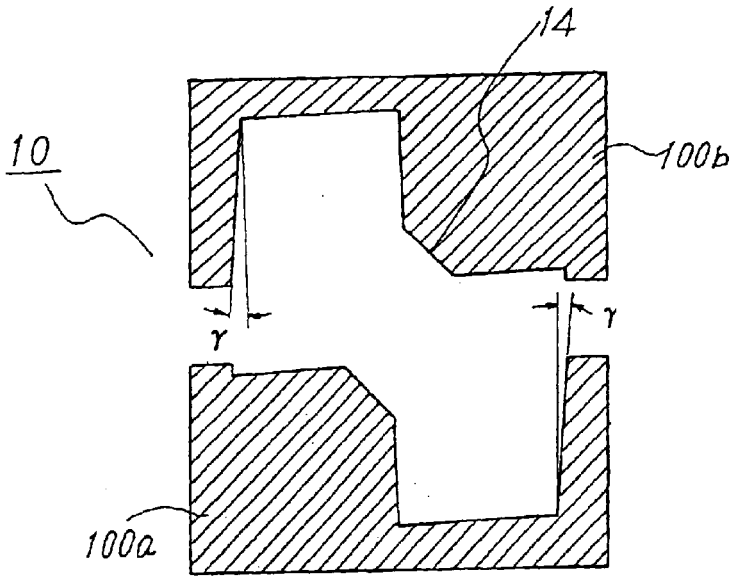

FIG. 9 is a cross sectional view showing metal molds for manufacturing the waveguide unit according to the third preferred embodiment of the invention.

Figure 3:
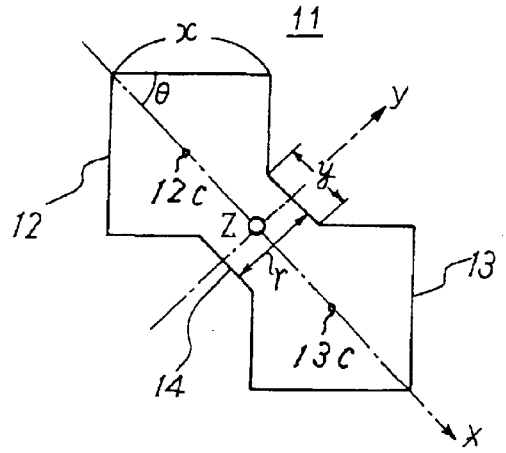
FIG. 3 is a view showing a shape of the slit provided in the waveguide unit according to the first preferred embodiment shown in FIG. 1.
Figure 10:
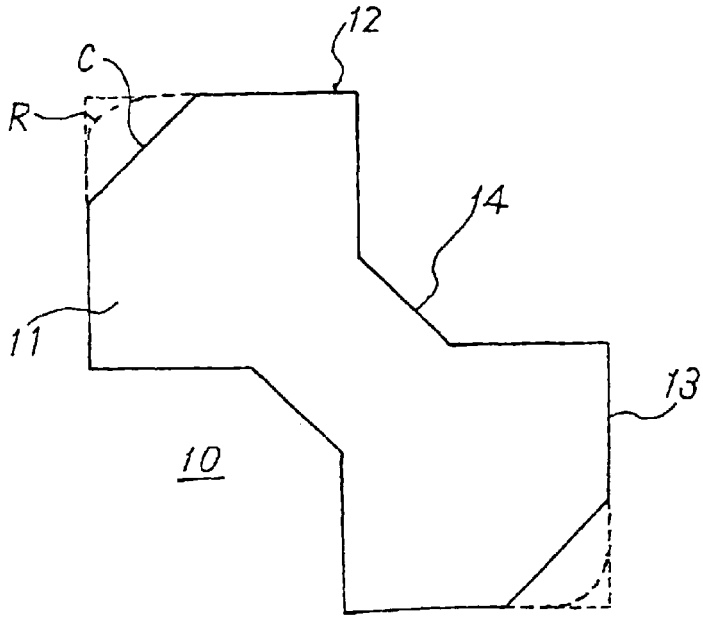

FIG. 10 is a view showing a modified embodiment of the slit shape shown in FIG. 3.

Figure 11:
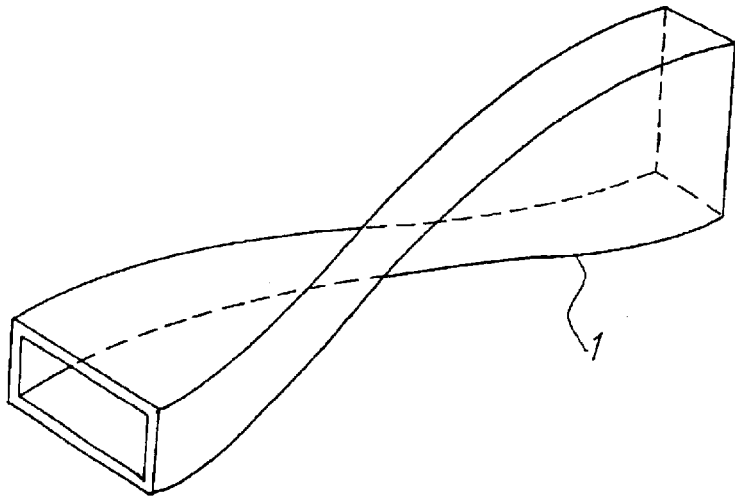
Fig. 11 (PRIOR ART)

FIG. 11 is a perspective view showing a conventional twisted waveguide unit.

Figure 12:
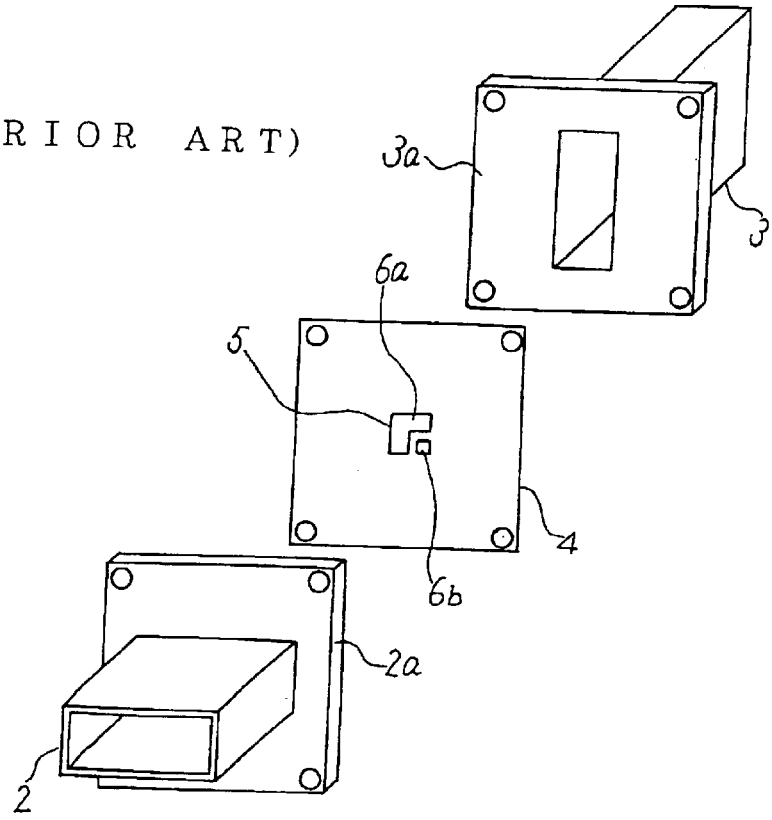
Fig. 12 (PRIOR ART)

FIG. 12 is an exploded perspective view showing another conventional waveguide unit which has a waveguide type-polarized wave converter with a resonant window.

DETAILED DESCRIPTION OF THE PREFERRED EMBODIMENTS

Embodiment 1

Figure 1:
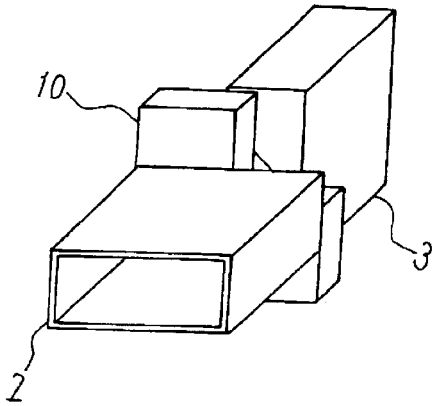
FIG. 1 is a perspective view of a waveguide unit according to a first preferred embodiment of the invention.

FIG. 1 is a schematic perspective view of a waveguide unit according to a first preferred embodiment of the invention, wherein a waveguide type-polarized wave converter 10 being interposed between a vertically polarized waveguide 2 and a horizontally polarized waveguide 3.

Figure 2:
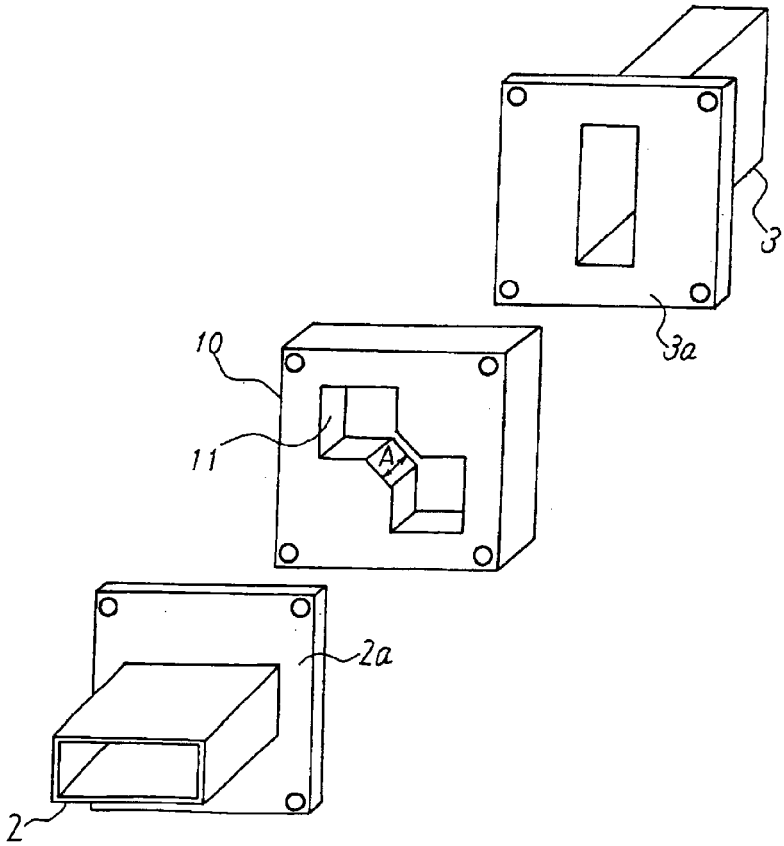
FIG. 2 is an exploded perspective view showing the detail of the waveguide unit according to the first preferred embodiment shown in FIG. 1.

FIG. 2 is an exploded perspective view showing a detailed construction of the waveguide unit according to a first preferred embodiment, in which the waveguide type-polarized wave converter 10, the vertically polarized waveguide 2, and a horizontally polarized waveguide 3 are disassembled by separating the connecting flanges 2*a*, 3*a*, respectively. In the waveguide type-polarized wave converter 10, a slit 11 is formed as described in detail hereafter, in which dimensions A in the direction to which the microwave travels is set to ¼ of the group wavelength of the unit. The purpose of the above setting is because the reflected waves appearing at a stepped portion of the waveguide unit, which are caused by susceptance in the distributed parameter lines, are cancelled each other, thus bringing a reflection characteristics to the best.

FIG. 3 is a view showing the detailed shape of the slit 11 provided in the waveguide type-polarized wave converter 10. The shape of the slit 11 is constituted by combination of the two quadrate parts 12, 13 and the connecting part 14 which connects the quadrate part 12 with the quadrate part 13 as to be a single polygonal shape.

In other words, assuming that X axis and Y axis are as shown in the drawing, the overall shape represents a polygonal periphery consisting of the combination of the two quadrate 12, 13 and the connecting part 14. Each quadrate 12, 13 has same size and is located on a plane which contains the orthogonal coordinate axes X and Y so that each quadrate is symmetrically located about the Y axis. Further, each center point 12*c* and 13*c* of the quadrates 12, 13 is located on the X axis and each side of the quadrates 12, 13 is at an angle of 45 degrees with the X axis. The connecting part 14 forms a ridge structure that is a narrow and straight shape.

Therefore, each side of the respective quadrates 12 and 13 is at an angle of 45 degrees with the X axis. The length x of each side of the quadrates 12,13 and the length y of the connecting part 14 are suitably set to its best value for exerting an preferable influence upon characteristic impedance, susceptance, and other characteristic in the distributed parameter lines. The length r of the connecting part 14 in the direction of Y axis is designed so that electromagnetic wave is concentrated on the ridge portion, causing susceptance appearing at the stepped portion of the waveguide to become smaller, and minimizing the reflecting wave generated therefrom.

FIGS. 4 (*a*) and 4(*b*) are views showing an overlapping state between the slit 11 of the waveguide type-polarized wave converter 10 and a vertically polarized waveguide 2 or a horizontally polarized waveguide 3 (see FIG. 2). The stepped portion refers to the portion which is not overlapped at the connecting portion between the polarized wave converter 10 and the polarized waveguide 2 or 3, and is shown with hatched portions V, W in FIGS. 4(*a*) and 4(*b*) respectively. The stepped portion is caused by the inclination of the slit 11 from the polarized waveguide 2 or 3 at the angle of 0, i.e. 45 degrees as shown in FIG. 3.

Now the operation of the above embodiment will be described with reference to FIGS. 1, 2, 3, 4(*a*) and 4(*b*). In FIG. 1 and FIG. 2, first of all, the vertically polarized wave-microwave signals are input to the left side opening of the vertically polarized waveguide 2, and enter into the waveguide type-polarized wave converter 10 through the vertically polarized waveguide 2. As described before, the waveguide type-polarized wave converter 10 has the ridge structure with which the electromagnetic field is concentrated on that portion. Therefore, even if the stepped portions V, W shown in FIG. 4 occupy substantially large area in the unit, the ridge structure enables to decrease reflection of electromagnetic field at the stepped portions.

In addition, as the length A in the waveguide type-polarized wave converter 10 in the direction to which the microwave travels is set to ¼ of the group wavelength of the unit, the residual reflecting waves are canceled each other at both of the stepped portion (hatched portion W in FIG. 4(*b*)) between the vertically polarized waveguide 2 and the waveguide type-polarized wave converter 10 and the stepped portion( hatched portion V in FIG. 4(*a*)) between the waveguide type-polarized wave converter 10 and the horizontally polarized waveguide 3.

Furthermore, the dimension of the slit provided in the waveguide type-polarized wave converter 10 is designed so that its characteristic impedance becomes equivalent to that of the vertically polarized waveguide 2 and the horizontally polarized waveguide 3. As the result, the reflecting wave caused by difference in the respective characteristic impedance values can be effectively minimized.

As described above, the microwave signals are converted by 90 degrees in its polarized wave face with the waveguide type-polarized wave converter 10 and are effectively transmitted to the horizontally polarized waveguide 3, and are finally output from the right end opening shown in FIGS. 1 and 2.

FIG. 5 is a graph showing a reflecting characteristic of the waveguide unit according to the present invention, plotting frequency (GHz) in the abscissa and reflecting coefficient (dB) measured by S parameter (S11) in the ordinate.

In general, it is required in this field that the value of S parameter S11 is less than −30 dB. Thus, the graph shows under the condition that a fractional bandwidth that is the ratio of the signal bandwidth (f2–f1) over the center frequency f0 is approximately 26% in this embodiment. This results in greatly improved broad band performance compared with the conventional waveguide type-polarized wave converter having the resonant window in which a fractional bandwidth is less than 10%.

Embodiment 2

This embodiment shows an example in which those polarized waveguides 2, 3 and polarized wave converter 10 are integrally manufactured but divided into two parts. FIG. 6 is an exploded perspective view showing the waveguide unit of the above integral structure, the integrated or unified waveguide unit is divided into two parts up and down at a divided face D to facilitate its manufacturing or its molding work.

In the drawing, the lower waveguide unit 100*a* and the upper waveguide unit 100*b* have geometrically identical form or structure each other. When they are unified at the divided face D by the screws through the connecting holes 20, the rectangular vertically polarized waveguide 2 is formed by the combination of the lower vertically polarized waveguide 2*a* and the upper vertically polarized waveguide 2*b*. As well, the rectangular horizontally polarized waveguide 3 is formed by the combination of the lower vertically polarized waveguide 3*a* and the upper vertically polarized waveguide 3*b*.

FIG. 7 is a cross sectional view taken in the line X—X in the FIG. 6 in an assembled state of the waveguide unit, the slit 11 of the waveguide type-polarized wave converter 10 being illustrated. This preferred embodiment enables to apply a mass production method such as a metal molding processing and a metal plating to aluminum-die-casting or plastic injection molding goods. FIGS. 8(*a*), 8(*b*), and 8(*c*) show the states in which the lower waveguide unit 100*a* or the upper waveguide unit 100*b* of FIG. 6 is formed with a metal-molding. FIG. 8(*a*) represents a cross sectional view taken in line A—A in FIG. 6, FIG. 8(*b*) in line B—B, and FIG. 8(*c*) in line C—C. In FIG. 8(*a*) to FIG. 8(*c*), numeral 21 denotes the upper metal mold, 22 the lower metal mold, 100*a* the lower waveguide unit. Taking these constitutions, the metal mold 21, 22 are easily moved up and down without any disturbance in the process of molding the waveguide unit 100*a*, as the result, it becomes possible for the waveguide unit to be easily manufactured with low cost.

According to the second embodiment, therefore, the polarized waveguides 2, 3 and polarized wave converter 10 are integrally manufactured but divided into two parts, thus, increasing in applicability for mass production using metal molding.

Embodiment 3

In the above embodiments, it is described cases in which the wall angle of the waveguide unit is 0, 45, or 90 degrees against X-axis and Y-axis. However, it is possible to use slightly larger angle than 0, 45, or 90 degrees to cause the metal mold to be pulled out more easily.

FIG. 9 shows an example of the waveguide unit 100*a*, 100*b* with the gradient y for pulling the metal mold out. The gradient $\gamma$ makes the metal mold put in or out easily, thus improving molding performance.

Embodiment 4

In above embodiments, it is described the cases in which a corner angle of the slit 11 is 90 degrees. FIG. 10 shows other modifications in the corner angle of the slit 11, more specifically, the quadrate parts 12, 13 of the slit 11 are tapered at the end corners as shown in a solid line C or are rounded as shown in a dotted line R.

These modifications lead to easier metal molding and improved plating stability of metal to be attached on the inner wall of the slit 11 by removing sharp edges as much as possible.

Whereas many alterations and modifications of the present invention will no doubt become apparent to a person of ordinary skill in the art after having read the foregoing description, it is to be understood that the particular embodiment shown and described by way of illustration is in no way intended to limit the scope of the claims which in themselves recite only those features regarded as essential to the invention.

What is claimed is:

1. A waveguide unit comprising:

a vertically polarized waveguide;

a horizontally polarized waveguide; and a waveguide type-polarized wave converter interposed between said vertically polarized waveguide and said horizontally polarized waveguide, said waveguide type-polarized wave converter having a slit on a face vertical relative to a guiding direction for wave travel, the shape of said slit being constituted by a combination of two quadrate parts and a connecting part for connecting the two quadrate parts, each of said quadrate parts being on a plane which contains orthogonal coordinate axes X and Y, and symmetrically located about the Y axis, each center point of the quadrates being located on the X axis, and at least a side of one of the guadrate parts makes an angle of 45 degrees with the X axis.

2. The waveguide unit according to claim 1, wherein a dimension of said slit in a direction to which the microwave travels is substantially set to ¼ of a group wavelength.

3. The waveguide unit according to claim 1, wherein each side of said quadrates is at an angle of 45 degrees with the X axis.

4. The waveguide unit according to eithef one of claims 1 to 3, wherein said vertically and horizontally polarized waveguides and said polarized wave converter are integrally manufactured and the waveguide unit has two parts.

5. The waveguide unit according to claim 4, wherein a divided face of said waveguide unit is at an angle of 45 degrees with the X axis or Y axis.

6. The waveguide unit according to claim 4, wherein at least one wall angle of the waveguide unit differs slightly from 0, 45, or 90 degrees.

7. The waveguide unit according to claim 4, wherein said quadrate parts of the slit are rounded or tapered at the end corners.

8. The waveguide unit according to claim 1, wherein said connecting part provides a ridge structure having a narrow and straight shape.

* * * * *